United States Patent [19]

Morellini

[11] Patent Number: 4,583,335

[45] Date of Patent: Apr. 22, 1986

[54] READY-TO-ASSEMBLE STAIRCASE SYSTEM FEATURING MODULAR COMPONENTS

[75] Inventor: Franco Morellini, Rolo, Italy

[73] Assignee: Mobirolo S.p.A., Italy

[21] Appl. No.: 604,320

[22] Filed: Apr. 26, 1984

[30] Foreign Application Priority Data

Jun. 17, 1983 [IT] Italy ..... 40059 A/83

[51] Int. Cl.[4] ..... E04F 11/00

[52] U.S. Cl. ..... 52/182; 52/183

[58] Field of Search ..... 52/182, 183, 9

[56] References Cited

U.S. PATENT DOCUMENTS 2,888,182 5/1959 Nixon ..... 52/183 X 3,099,336 7/1963 Hawkins ..... 52/182

*Primary Examiner*—Carl D. Friedman

*Attorney, Agent, or Firm*—Darby & Darby

[57] ABSTRACT

The invention relates to a staircase system featuring modular construction components, wherein the framework of the staircase itself is produced by assembly of modular components paired one with the next in sequence so as to form a bearing structure for the single stair treads. The modular components are prismatic in shape and slot together reciprocally in a number of positions one relative to the other so as to a give a variety of reciprocal positions—at least, in the vertical plane. Each modular component consists of a length of molding whose cross section has an elongated profile which remains constant throughout. The molding is disposed so that its main longitudinal axis is horizontal following assembly. The reciprocal type of connection between one component and the next is brought about by tongues and grooves formed on the vertical side faces of one component and on the mutually-opposed and inwardly-set vertical faces of the next component, between which the first component is partially inserted. Once the components are interlocked, the tongues and grooves inhibit any relative movement whatsoever of either component other than parallel to the horizontal axes of the individual moldings used for their formation.

15 Claims, 11 Drawing Figures

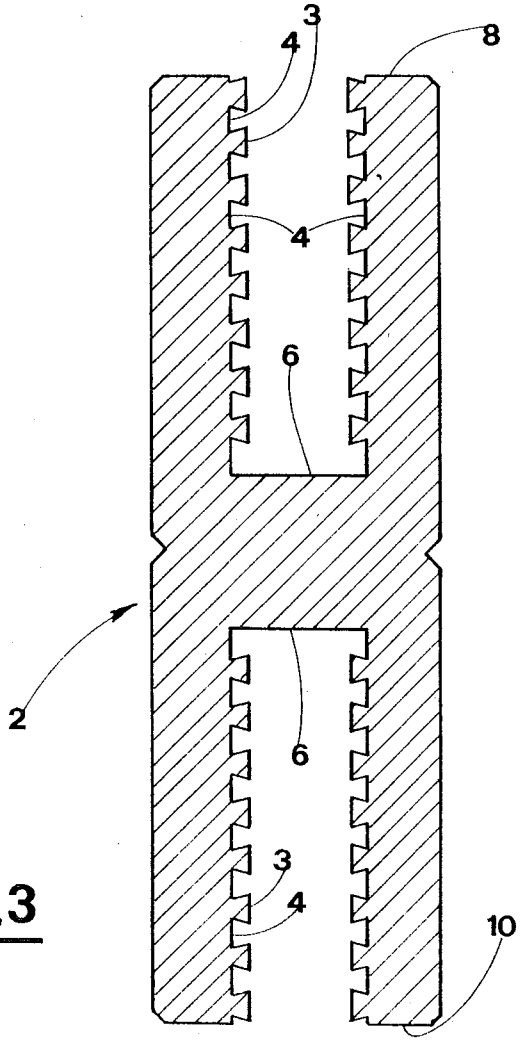
Fig.3
Fig.2
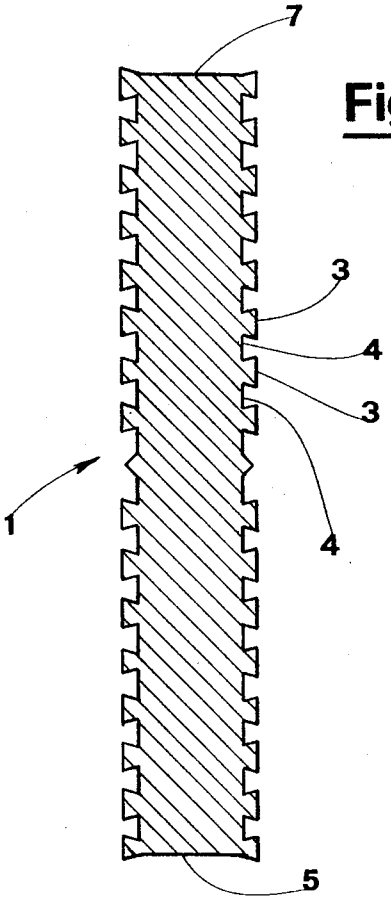

READY-TO-ASSEMBLE STAIRCASE SYSTEM FEATURING MODULAR COMPONENTS

BACKGROUND OF THE INVENTION

The invention described herein relates to a ready-to-assemble type of staircase in which modular components are utilized.

The prior art in this field offers staircases for whose construction modular components are employed, these being fitted together to provide a bearing structure, or framework, to which the stair treads are subsequently fixed. Such known types of assembly offer little load-bearing capacity and poor stability generally speaking, by the very nature of their construction. What is more, the strength and functional characteristics of conventional staircase assemblies are not such as to render them suitable for permanent installation constructed, for example, from materials such as reinforced concrete, metal, or metal-and-brick, which are commonly employed in civil construction for the stairways interconnecting various stories of a building.

The main object of the invention described herein is that of providing a ready-to-assemble staircase system featuring modular components, which offers superior strength and stability and thus permits a universal type of use in building.

Another object of the invention is to provice a simple adjustment of the rise-and-tread dimensions of the single steps without any additional parts being introduced.

A further object of the invention is to provide a ready-to-assemble staircase system made up of modular components whose assembly is markedly simple.

SUMMARY OF THE INVENTION

These and other objects are realized with the invention described herein which sets forth a ready-to-assemble staircase system featuring modular components, characterized in that the staircase system of the present invention comprises a framework serving to support the single stairs which is produced by the assembly of a plurality of modular components paired one with the next in sequence so as to provide a bearing structure; each of said modular components being prismatic, slotted with the next in reciprocal fashion, and consisting of a length of molding whose basically elongated-type cross-section remains constant throughout, and whose main longitudinal axis lies horizontally disposed following assembly; and in that joining means are provided which permit pairing together of said modular components in reciprocal fashion and in a number of varying reciprocal positions; such joining means being embodied so as to associate at least one of the vertical faces of a first component with at least one of two mutually-opposed inwardly-set vertical faces of a second component between which said first component is partially inserted; the association thus produced being a prismatic fit which inhibits reciprocal movement of either component in any direction other than parallel to the horizontal axes of the individual moldings which constitute the joined components.

BRIEF DESCRIPTION OF THE DRAWINGS

A number of embodiments of the invention will now be described by way of example, with the aid of accompanying drawings, in which:

FIGS. 2 and 3 show cross-sections through two dissimilar modular components which when joined together provide the basis of the bearing structure in FIG. 1;

DESCRIPTION OF THE PREFERRED EMBODIMENTS

Figure 1:
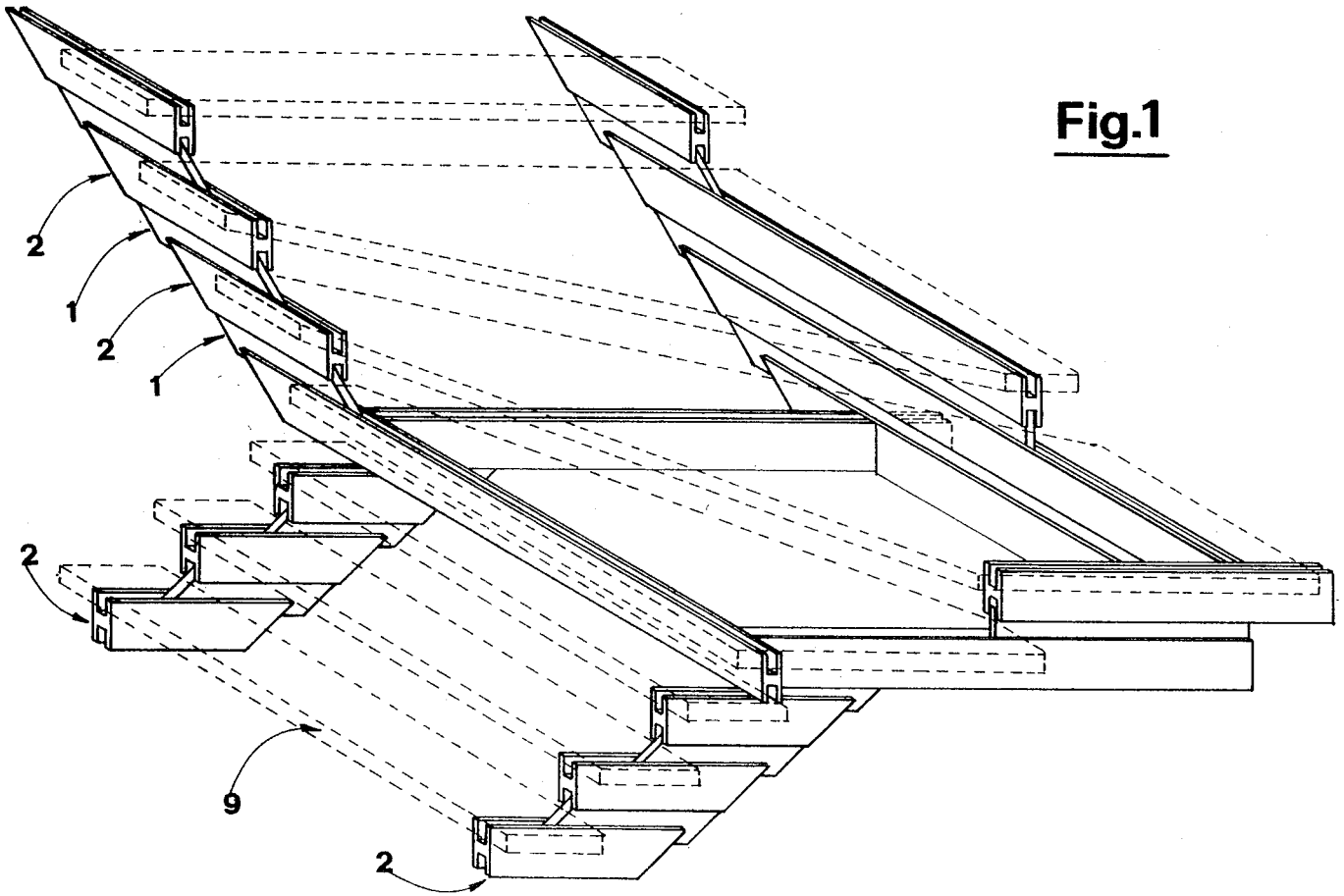
FIG. 1 is the view in perspective of a first embodiment of a ready-to-assemble staircase as described herein.

With reference to the drawings, reference numerals 1 and 2 denote two modular components according to a first type of embodiment of the invention. The modular components 1 and 22 are joined in reciprocal fashion, with one slotting into the other. Component 1 is in essence a molding, cut to a given length and exhibiting an elongated rectangular cross-section whose vertical faces each incorporate a number of evenly-spaced and alternated tongues 3 and grooves 4, which are arranged on vertical faces at either side of said component 1 such that their distribution is perfectly symmetrical with respect both to the central axis of the component's cross-section and to the horizontal axis of the component itself. The tongues 3 formed on component 1 are identical one to the other, spaced apart at equal distance one from the next, and given a dovetail profile. Likewise, the alternately-set grooves 4 are identical, equally-spaced, and dovetailed.

Component 2 of the two modular components according to the first embodiment takes the form of a length of molding with an "H" cross-section, whose mutually-opposed inwardly-set vertical faces each incorporate a number of evenly-spaced and alternated tongues 3 and grooves 4 of size and shape such as to engage, by way of insertion through a longitudinal path, with the corresponding grooves 4 and tongues 3 offered thereto by opposite vertical faces of said component 1.

Tongues 3 formed on component 2 are identical one to the other, spaced apart at equal distance one from the next, and present a dovetail profile; and in like manner, grooves 4 alternating therewith are identical, equally-spaced and dovetailed so as to accommodate grooves 3 formed on the vertical faces of component 1 to an exact fit.

Components 1 and 2 can be paired one with the next in sequence with the utmost simplicity, by virtue of their very shape and form. The association of one component with the next requires no more than the insertion of the first 1 between the mutually-opposed inwardly-set top or bottom faces of the second component 2, along a line parallel to the main longitudinal axes of the two components themselves, such that tongues 3 formed on component 1 engage within the grooves 4 formed in the mutually-opposed inwardly set faces of component 2, and such that tongues 3 of the latter engage likewise with the grooves 4 alternated as aforesaid with the tongues of component 1.

Given the equidistant spacing of the tongues and grooves on both components, component 1 can be paired with component 2 in a number of different positions, each position providing a variation in the distance from the base 6 of the slot in component 2 to the bottom-edge 5 or the top-edge 7 of component 1 when inserted thereinto. With the system thus described, one has the possibility of creating bearing structures of varying height using the same number of reciprocally-assembled modular components 1 and 2, according to the variable distance at which the components 1 and 2 are slotted together.

Thus, by assembling the modular components 1 and 2 described, in sequence, one on top of the next, one creates a strong bearing structure to which treads of a stair can be fixed; moreover, the assembly procedure is simple in the extreme. Given the type of slotted connection between components 1 and 2 characterized by their sliding in an axial direction, means for locking the components together in the desired position will need to be provided—screws or bolts, for instance—so as to prevent any unwarranted axial slide of each of the components following assembly.

Figure 5:
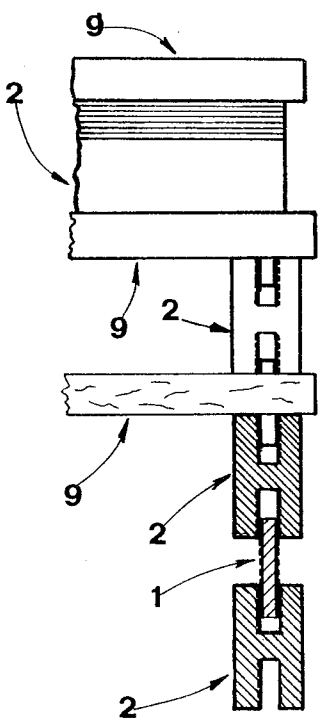
FIG. 5 is a detail of the section through IV—IV, FIG. 4.
Figure 4:
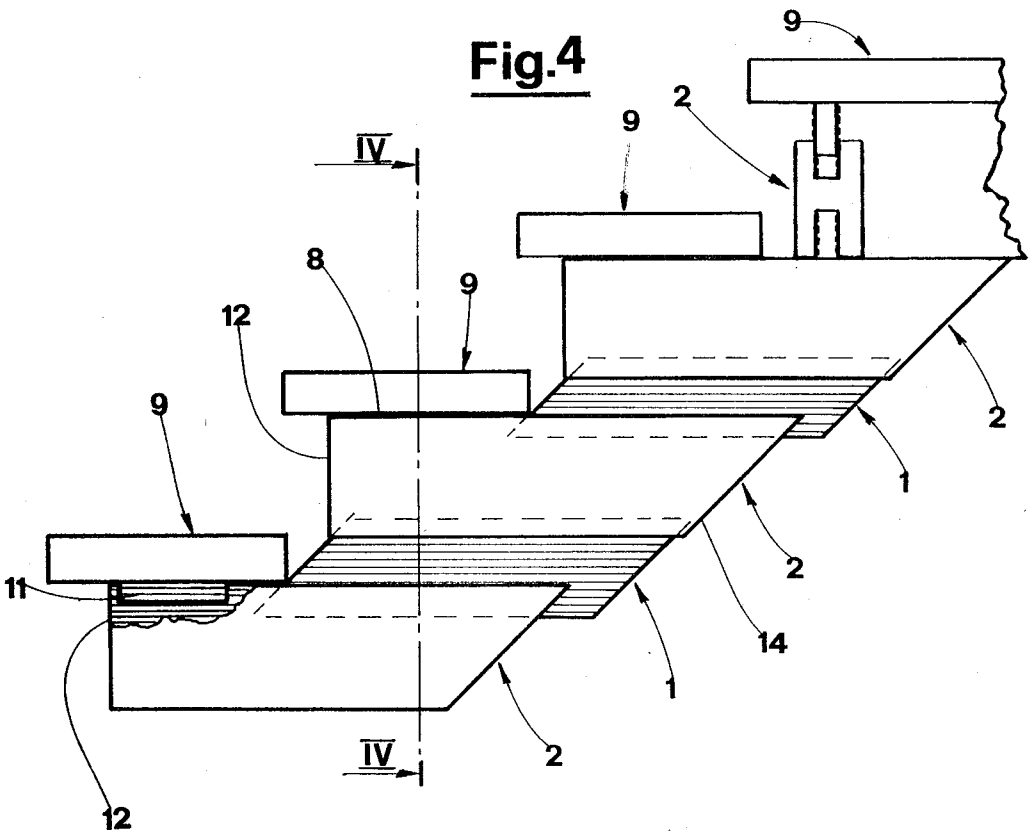
FIG. 4 is a side elevation of part of the staircase as pictured in FIG. 1.

FIGS. 1, 4 and 5 illustrate a ready-to-assemble staircase system employing a plurality of modular components 1 and 2 paired together in sequence one on top of the next. In this particular instance, each of the first components 1 takes the form of a length of light-alloy molding—aluminum or some other such material—whose two ends are parallel, and at the same time angled with respect to the vertical axis of the component itself (at approximately 45°), this principally for the sake of appearance.

Component 2 in FIGS. 4 and 5 is again a length of "H"-type molding, whose foremost end 12 is disposed plumb, and whose rear end 14 is disposed at the same angle as the ends of said component 1, with respect to the vertical. Modular components 1 and 2 are paired one with the next in sequence so as to create a bearing structure in which the foremost part of the top-edge 8 of component 2 remains free to accommodate the step, or stair tread 9.

Treads 9 are attached to the bearing structure thus produced in markedly simple fashion. The joint between the single tread 9 and component 2 is created by the use of a length of molding identical to that utilized for component 1, though of reduced height with respect to the latter—in practical application, less than half the height of component 1; the length of molding is fixed uppermost to the tread 9, and inserted lengthwise between the mutually-opposed inwardly-set vertical faces uppermost in component 2, by slotting thereinto.

In the staircase illustrated in FIG. 1, it will be observed that the bearing framework is divided into two parts, basically speaking the two parts are disposed parallel one to the other and set apart at a given reciprocal distance. Each part is created by assembling a plurality of modular components 1 and 2, in sequence, one on top of the other. In the embodiment illustrated, each of the treads 9 has two lengths of molding 11 fixed to its underside, one near to each end. The lengths of molding 11 are identical in shape and form to the molding utilized for component 1 when seen in cross section, though their height is markedly less than that of the latter, and are positioned parallel to each other at a given reciprocal distance which will permit their being slotted in between the mutually-opposed uppermost vertical faces of the pair of components 2 lying at the same level on each of the framework's parallel bearing structures.

It will also be observed from FIG. 1 how the construction of a landing—in this instance, a right-angle turn incorporating an intermediate winder—is achieved utilizing modular components 1 and 2 positioned at either side and having identical cross section, but of different length.

Thus, the staircase bearing structure complete with landings of whatever shape or form can be constructed entirely of modular components as hitherto described. Furthermore, given the possibility of associating the modular components 1 and 2 at variable height one on top of the next, one has a simple means of selecting the stair rise measurement at the moment of assembly, and by definition, of determining the height of the staircase overall.

A further advantage of the invention is that of its permitting adjustment of the depth of tread, front to rear. This is achieved simply by sliding the two assembled components 1 and 2 in an axial direction, one relative to the other, so as to obtain the appropriate position.

Figure 7:
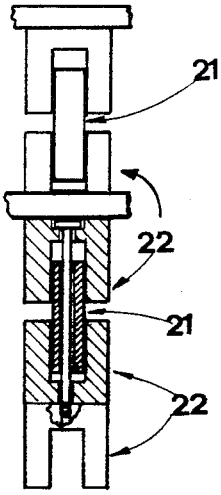
FIG. 7 is the section through VI—VI, FIG. 6.
Figure 6:
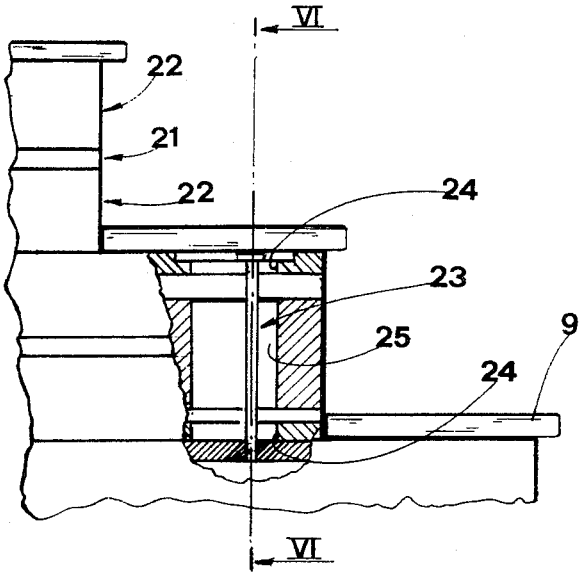
FIG. 6 is the side elevation of a bearing structure produced by the assembly of modular components according to a second type of embodiment; the view being in cutaway.
Figure 8:
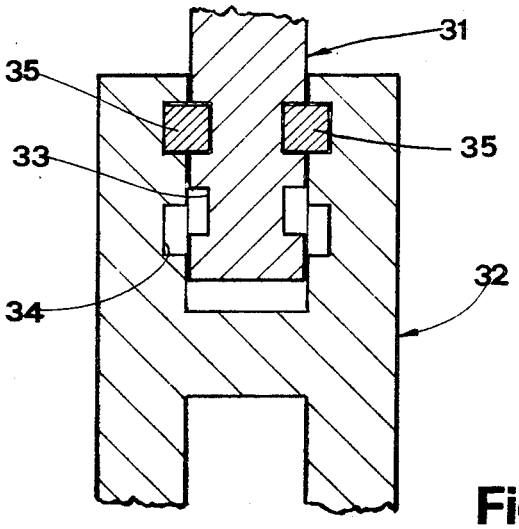
FIG. 8 is the cross-section through two reciprocallyjoined modular components, according to a third type of embodiment.

FIGS. 6 and 7 illustrate a second type of embodiment of the invention, wherein the staircase's bearing structure is composed of a number of assembled modular components 21 and 22 fitted one on top of the other in sequence. Component 21 consists of a length of molding whose cross-section is identical to that of component 1 aforedescribed. Component 22 likewise takes the form of a length of molding, in this case exhibiting a "U" cross section. The mutually-opposed inwardly-set vertical faces of each modular component 22 provide a number of tongues and grooves for jointing purposes the tongue and grooves are formed alternately and are spaced apart such as to engage identical and corresponding grooves and tongues formed on the vertical faces at either side of each modular component 21. The assembly and vertical alignment of modular components 22 when paired up in sequence with modular components 21 to create the bearing structure, are brought about by fastening means consisting, for instance, of long bolts 23. Each single bolt 23 connects three modular components 22. The top two components 22 are slotted over one common component 21 the bolts 23 screws into a threaded hole located in the top edge of the third component 22 beneath, the shank of the bolt passing through longitudinal slots 25 and 24 provided in component 21 and its associated components 22, respectively. These slots allow the depth of tread to be adjusted from front to rear. The tread 9 itself is screwed to component 22 at either side of the staircase.

A third embodiment of the invention includes a first modular component 31 consisting of a length of molding having an elongated-type rectangular cross section with one or more longitudinally-disposed grooves 33 located either in both vertical faces, or in one face only. A second modular component 32 designed to join with component 31 by slotting, also consists of a length of molding, in this instance exhibiting an "H" cross-section, and has longitudinally-disposed grooves 34 located in at least one of the mutually-opposed inwardly-set vertical faces of each of the two slots composing the "H". The first mentioned groove 33 in component 31 and the last-mentioned groove 34 in component 32 are of shape and form such as to accommodate a prismatic element 35 which is slotted lengthwise into the matching hole created by alignment of grooves 33 and 34 one with the other when components 31 and 32 are brought together and arranged in the appropriate position, one relative to the other.

Figure 11:
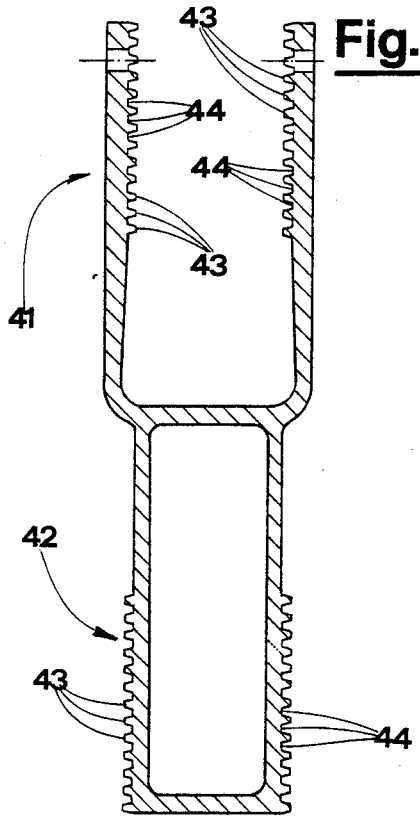
FIG. 11 is the cross-section through the single modular component utilized in creating the bearing structure as illustrated in FIG. 10.
Figure 10:
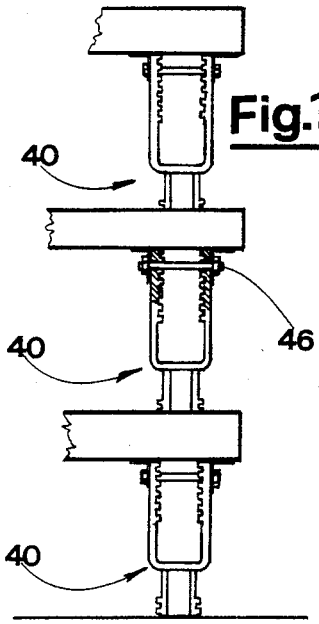
FIG. 10 is a schematic, showing the assembly in FIG. 9 from the left.
Figure 9:
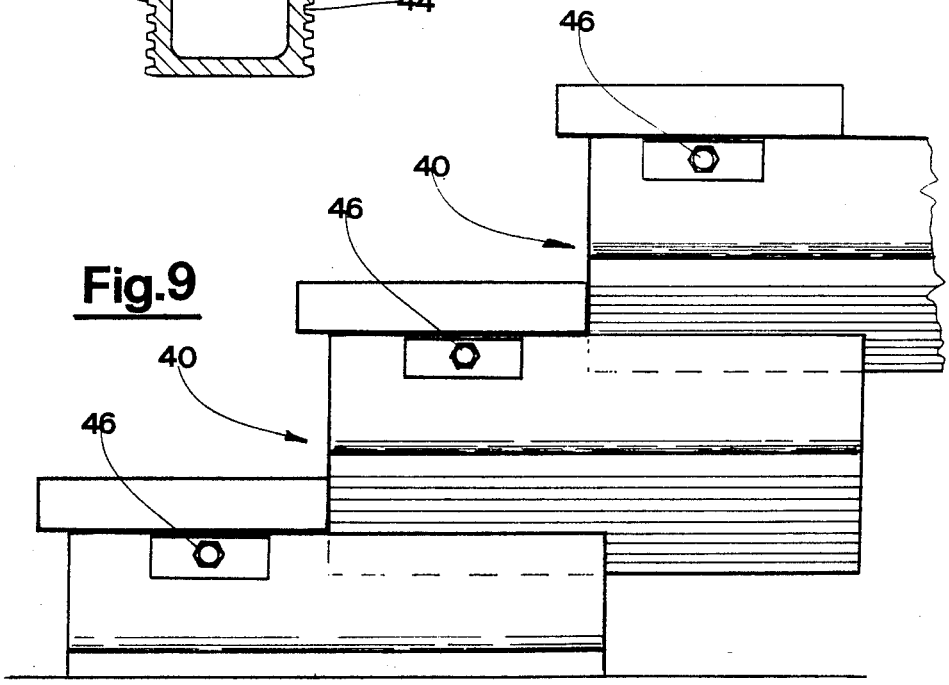
FIG. 9 shows part of the side-elevation of a bearing-structure produced by the assembly of modular components according to a fourth type of embodiment.

A fourth embodiment of the invention illustrated in FIGS. 9, 10 and 11 includes a plurality of single and identical modular components 40, assembly of which in sequence, one on top of the next, produces the bearing structure for a staircase as claimed herein. The single modular component 40 takes the form of a length of composite molding which has an elongated-type profile when seen in cross-section, the profile having a distinct lower part 42 and upper part 41, the latter of "U" shape.

The outer vertical faces of the lower part 42 are provided with ribs 43 and with grooves 44 for joining purposes the ribs 43 and grooves 44 are spaced apart alternately at equal distance one from the next. The mutually-opposed and inwardly-set vertical faces of the "U"-shaped upper part 41 likewise have laternating ribs 43 and grooves 44 of shape, size and spacing such as to engage with the grooves and ribs of the lower part 42 by slotting lengthwise thereover, and remain interlocked therewith in reciprocal fashion.

Thus two similar modular components 40 are joined together by slotting the lower part 42 of the one into the upper part 41 of the other, lengthwise, and in such a way that the ribs 43 and grooves 44 of the lower part engage with corresponding grooves 44 and ribs 43 formed in the inwardly-set vertical faces of said upper part.

The cross section of the modular component 40 thus embodied is perfectly symmetrical with respect to its own central vertical axis, the ribs 43 being identical one with the other and having a tapered profile. The grooves 44 alternating with said ribs 43 likewise are identical one to the other, and are tapered into the root when seen in profile.

When pairing the lower part 42 of one modular component with the upper part 41 of the next, the ribs 43 of the one are received by the grooves 44 of the other, making reciprocal contact solely by way of their tapered flanks 45. In this way, tightening together of the upper part 41 and the lower part 42 with a nut and bolt fastener 46 once in position, will lock the two adjacent modular components together and take up any existing play between ribs 43 and grooves 44.

As with the first through third embodiment previously discussed, this fourth embodiment provides the possibility of joining modular components 40 together at varying height one on top of the other, this being brought about simply, and at the actual moment of assembly. Thus one has adjustment of the rise-height of single steps, and definition, of the height of the staircase overall.

Adjustment of the tread-depth from front to rear is provided by securely locking the joined modular components 40 with their respective nut and bolt 46 after the components 40 are properly positioned.

The staircase created with the modular system as described herein offers excellent strength, and may be employed in a wide variety of building applications.

What is claimed:

1. A staircase assembly, which comprises:

a plurality of modular components paired one with the next in sequence to provide a bearing structure for a staircase framework;

each of said modular components being slotted with the next in reciprocal fashion, and being formed from a length of molding having basically an elongated-type cross section which remains substantially constant throughout, and having a main longitudinal axis which lies horizontally disposed following assembly;

means for joining pairs of the modular components in reciprocal fashion and in a variety of reciprocal positions, the modular components including a first component having at least one vertical face, and a second component having two mutually-opposed inwardly-set vertical faces between which said first component is partially inserted to mate the first component with the second component, said joining means being formed on the at least one vertical face of the first component and on at least one of the faces of the second component to substantially inhibit reciprocal movement of either of the first and second components in any direction other than parallel to the horizontal axes of the individual moldings which form the mated first and second components.

2. Staircase assembly as in claim 1 characterized in that the first component of the plurality of modular components is formed of a length of molding having an elongated-type cross section, and the second component of the plurality of components is formed of a length of molding having an "H"-type cross section.

3. Staircase assembly as in claim 1 characterized in that the joining means includes evenly-spaced and alternating tongues and grooves formed on the at least one vertical face of the first modular component, and even-spaced and alternating tongues and grooves formed on at least one of the mutually-opposed inwardly-set vertical faces of the second modular component and having a shape and form such as to engage corresponding grooves and tongues formed on the at least one vertical face of said first component when the first component is slotted lengthwise into said second component.

4. Staircase assembly as in claim 3 characterized in that the first component includes two vertical faces on opposite sides thereof, and that said tongues and grooves are arranged across the two vertical faces at either side of said first component in such a way as to lie substantially symmetrical with respect both to the central vertical axis of said first component's cross section, and to the main horizontal axis of said first component; and wherein said tongues are identical one with the other, and given a dovetail profile, and said grooves are likewise identical one to the other and given a dovetail profile.

5. Staircase assembly as in claim 4 characterized in that each first modular component includes a length of molding having two ends which are parallel and angled with respect to the vertical axis of the first component.

6. Staircase assembly as in claim 3 characterized in that the tongues and grooves for joining purposes are arranged on the two pairs of mutually opposed and inwardly-set vertical faces of said second modular component and are arranged in such a way as to lie substantially symmetrical with respect both to the central vertical axis of said second component's cross section and to the main horizontal axis of said second component; wherein said tongues formed on the second component are identical one to the other, spaced apart at equal distance one from the next, and have a shape and form such as to engage to an exact fit in the grooves of said first component wherein said groove formed in the second component are likewise identical one to the other, spaced apart at equal distance one from the next, and have a shape and form such as to accommodate tongues formed on said first component to an exact fit; and wherein the tongues and grooves of said second component have a dovetail profile.

7. Staircase assembly as in claim 6 characterized in that each second modular component includes a length of molding having an "H" cross section, the molding having a foremost end and a rear end, the foremost end being disposed parallel with the rear end the rear end being angled with respect to the vertical axis of the second component.

8. Staircase assembly as in claim 6 characterized in that each second modular component includes a length of molding having an "H" cross section, the molding having a foremost end and a rear end, the foremost end being disposed plumb with the rear end.

9. Staircase assembly as in claim 3 which further comprises at least one stair tread, and a length of molding fixed to the underside of the at least one stair tread, the molding of the at least one stair tread being of identical cross section to the molding utilized for the first modular component, though of reduced height with respect to the first component, and as such being adapted to be slotted lengthwise between the two mutually-opposed inwardly-set vertical faces of the second modular component.

10. Staircase assembly as in claim 1 characterized in that the assembly further includes two sets of paired modular components, each set forming a bearing structure for a staircase framework, each set including at least one first component and at least one second component, said bearing structures being disposed parallel one with the other at a given reciprocal distance; and wherein the assembly further includes at least one stair tread disposed transversely to said parallel bearing structures, the at one tread including two lengths of moldings fixed to the underside of the at least one tread, said moldings having identical outer profiles to the molding utilized for said first component though reduced in height with respect to the first component, said moldings being disposed parallel one with the other at a reciprocal distance which will permit their being slotted into the mutuallyopposed inwardly-set vertical faces of the at least one second component of each set on either side of said framework.

11. Staircase assembly as in claim 1 characterized in that the first modular component is formed from a length of molding having an elongated-type cross section of rectangular shape; and wherein the first component includes vertical side faces, each vertical side face of the first component having formed thereon a plurality of tongues and grooves for joining purposes arranged alternately one with the next; and wherein the second modular component is formed from a length of molding having a "U"-type cross section, the mutually-opposed inwardly-set vertical faces of the second component having formed thereon a plurality of tongues and grooves for joining purposes, the tongues and grooves of the second component being arranged alternately on said vertical faces one with the next and having a shape and form such as to engage corresponding grooves and tongues formed on the vertical side faces of the first component when the first component is slotted lengthwise into said second component;

and wherein the assembly further comprises screw-in type fastening means for connecting together and vertically aligning the second and first components when the first and second components are paired one with the next in sequence to form the staircase bearing structure.

12. Staircase assembly as in claim 1 characterized in that the first modular component is formed from a length of molding having an elongated-type rectangular cross section, the at least one vertical side face of the first component having formed therein at least one longitudinally-disposed groove for joining purposes; and wherein the second modular component is formed from a length of molding having an "H"-type cross section, the second component having at least one longitudinally-disposed groove for joining purposes formed in at least one of its mutually-opposed inwardly-set vertical faces, the longitudinal grooves formed in the first and second components being dimensioned to partially receive a joining member when the first and second components are positioned relative to each other so that their respective longitudinal grooves are aligned.

13. Staircase assembly as in claim 1 characterized in that the first component of the plurality of modular components is formed of a length of molding having an elongated-type cross section, and the second component of the plurality of components is formed of a length of molding having an "U"-type cross-section.

14. A staircase assembly, which comprises: a plurality of identical, modular components arranged adjacent one another in sequence, adjacent identical component being joined together to form a bearing structure for a staircase framework, each identical component being formed from a length of molding having an elongated type of profile when viewed in cross section, said profile having a distinct lower part and upper part, the upper part being of "U"-shape, the lower part having vertical side faces and the upper part having mutually-opposed inwardly-set vertical faces, the vertical faces of the upper and lower parts having formed thereon evenly-spaced and alternating ribs and grooves for joining purposes, each of said ribs and said grooves having a shape and form such as to allow two adjacent modular components to be slotted together in a lengthwise direction whereby the lower part of one adjacent component engages with the upper of the other adjacent component and the ribs and grooves of said lower part of said one adjacent component interlock with corresponding grooves and ribs of said upper part of said other adjacent component.

15. Staircase assembly as in claim 14 characterized in that said ribs and said grooves are arranged on the two vertical side faces of said lower part and on the two mutually-opposed inwardly-set vertical faces of said upper part of each single modular component such as to lie substantially symmetrical with respect to the central vertical axis of said each single modular component's cross section; wherein said ribs are identical one to the other and have a tapered profile in cross section; and wherein said grooves are identical one to the other and have a profile that tapers into the roots of said grooves when viewed in cross section.

* * * * *